United States Patent [19]

Yamazaki et al.

[11] 4,310,594

[45] Jan. 12, 1982

[54] COMPOSITE SHEET STRUCTURE

[75] Inventors: Yasuyuki Yamazaki; Shingo Emi; Susumu Norota; Kazuo Takamatu; Tomoyoshi Ono, all of Iwakuni, Japan

[73] Assignee: Teijin Limited, Osaka, Japan

[21] Appl. No.: 165,079

[22] Filed: Jul. 1, 1980

[51] Int. Cl.[3] ..... D04H 3/03; D04H 3/14; D04H 3/16

[52] U.S. Cl. ..... 428/296; 428/246; 428/252; 428/253; 428/256; 428/297; 428/298; 428/299; 428/303; 428/332; 428/340; 428/369; 428/316.6

[58] Field of Search ..... 428/221, 229, 255, 296, 428/303, 297, 298, 299, 332, 340, 369, 303

[56] References Cited

U.S. PATENT DOCUMENTS

| | | | |
|---|---|---|---|
| 3,511,747 | 5/1970 | Davies | 428/296 |
| 3,616,149 | 10/1971 | Wincklhofer | 428/296 |
| 3,616,160 | 10/1971 | Wincklhofer | 428/296 |
| 4,068,036 | 1/1978 | Stanistreet | 428/296 |
| 4,131,704 | 12/1978 | Erickson | 428/296 X |
| 4,160,059 | 7/1979 | Samejima | 428/288 |
| 4,229,472 | 10/1980 | Suskind | 428/296 X |
| 4,234,655 | 11/1980 | Kunimune | 428/374 |
| 4,269,888 | 5/1981 | Ejima | 428/296 |

FOREIGN PATENT DOCUMENTS 52-49284 4/1977 Japan .

*Primary Examiner*—Dennis L. Albrecht
*Attorney, Agent, or Firm*—Sherman & Shalloway

[57] ABSTRACT

A composite sheet structure comprising (A) a nonwoven web composed of (a) continuous filaments of a synthetic resin and (B) a net-like web having intersecting points and being composed of (b) continuous net strands of a mixture consisting of at least two thermoplastic synthetic resins having different melting points, said web (A) and said web (B) being bonded to each other by heating; characterized in that (i) said web (A) has a basis weight of about 2 to about 30 g/m$^2$, (ii) said web (B) has a basis weight of about 1 to 10 g/m$^2$, an average net strand diameter of about 1 to about 100 microns, and an average mesh length of up to about 5 mm, and said net strands (b) are composed of at least two resins having melting points differing from each other by at least about 20° C., of which a resin having the lowest melting point has a melting point at least about 20° C. lower than that of said filaments (a) and is present in an amount of about 5 to about 95% by weight based on the weight of said resin mixture, (iii) the amount of said web (A) is about 30 to about 90% by weight based on the total weight of said webs (A) and (B), (iv) said composite sheet structure has a basis weight of about 10 to about 200 g/m$^2$, and (v) said filaments (a) are partly embraced by said net strands (b) throughout the composite sheet structure.

3 Claims, 3 Drawing Figures

COMPOSITE SHEET STRUCTURE

Figure 1:
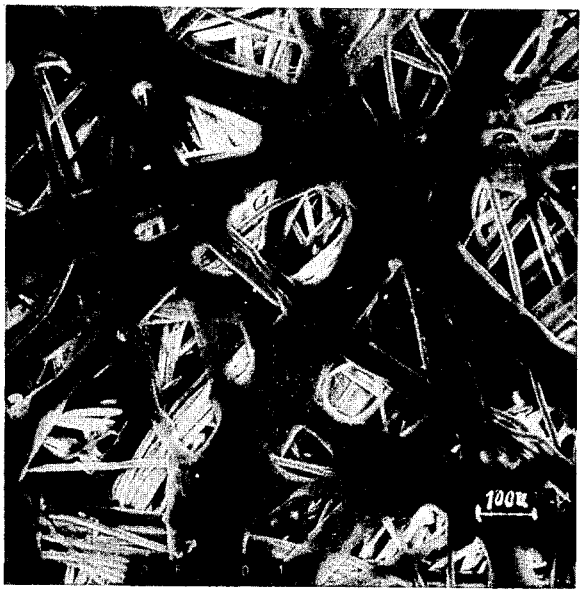

This invention relates to an improved composite sheet structure having various superior properties, especially high flexibility, excellent nap resistance, good air permeability, high strength, good heat sealability and light weight.

More specifically, this invention pertains to a composite sheet structure comprising (A) a nonwoven web composed of (a) continuous filaments of a synthetic resin and (B) a net-like web having intersections and being composed of (b) continuous net strands of a mixture consisting of at least two thermoplastic synthetic resins having different melting points, said web (A) and said web (B) being bonded to each other by heating; characterized in that (i) said web (A) has a basis weight of about 2 to about 30 g/m$^2$, (ii) said web (B) has a basis weight of about 1 to about 10 g/m$^2$, an average net strand diameter of about 1 to about 100 microns and an average mesh length of up to about 5 mm, and said net strands (b) are composed of at least two resins having melting points differing from each other by at least about 20° C., of which a resin having the lowest melting point has a melting point at least about 20° C. lower than that of said filaments (a) and is present in an amount of about 5 to about 95% by weight based on the weight of said resin mixture, (iii) the amount of said web (A) is about 30 to about 90% by weight based on the total weight of said webs (A) and (B), (iv) said composite sheet structure has a basis weight of about 10 to about 200 g/m$^2$, and (v) said filaments (a) are partly embraced by said net strands (b) throughout the composite sheet structure.

A great number of techniques have been known about a nonwoven web composed of continuous filaments of synthetic resin in which the individual filaments are arranged at random, and methods for production thereof. For example, a spun-bond method and a fiber opening or spreading method have been suggested to produce such a nonwoven web.

Many techniques have also been known for giving practical interfilament bonding to such a nonwoven web. They include, for example, the use of a binder, physical intertwining means such as needling using a needle or fluid, and heat bonding utilizing the melt-bondability of filaments, either singly or in combination.

High flexibility is incompatible with excellent nap resistance or with high strength, and good air permeability is likewise incompatible with superior nap resistance. It is impossible in practice to provide a well-balanced combination of desirable properties, for example high flexibility, excellent nap resistance, good air permeability and high strength.

In an attempt to provide a nonwoven composite sheet structure having a fibrous hand, air permeability and practical strength, Japanese Laid-Open Patent Publication No. 49284/77 published Apr. 20, 1977 suggested a structure comprising (A) a nonwoven web composed of (a) continuous filaments of synthetic thermoplastic resin and (b) a net-like web having intersecting points and being composed of (b) continuous net strands of thermoplastic synthetic resin composed of a mixture of at least two resins having different melting points, said webs (a) and (b) being bonded to each other by heating.

According to this Patent Publication, the nonwoven composite sheet structure is produced by extruding a thermoplastic resin mixture composed of at least two resins having different melting points such as polyethylene (m.p. 100°-135° C.) and polypropylene (m.p. 160°-175° C.), and a blowing agent into a sheet form from an extruder to produce a foamed open net-like web, superimposing at least one layer of such net-like web on a reinforcing material of a thermoplastic resin having a melting point equal, or close, to that of a resin having the lowest melting point among the resins in the aforesaid mixture, such as a polyethylene net having melt-bonded intersecting points, and consolidating the assembly under heat and pressure under such conditions that the reinforcing material is melt-bonded to the net-like web.

As shown in Comparative Example 6 given hereinbelow, the web (A) and the web (B) can be melt-bonded so that the resulting composite sheet structure has sufficient strength. However, the flexibility of the resulting sheet structure is drastically reduced, and moreover, the sheet structure has poor air permeability. It has been found therefore that a sheet structure having both of these properties in a balanced state cannot be obtained by this technique.

The present inventors have worked extensively in order to provide an improved composite sheet structure which retains uniform and random dispersion and arrangement of filaments, and has a well-balanced combination of high flexibility, excellent nap resistance, good air permeability and high strength.

It has been found consequently that a composite sheet structure having a unique characteristic three-dimensional structure (relative structure in the thickness direction and planar directions of the sheet structure) can be provided by using (B) a net-like wet having integrated intersecting points and being composed of continuous net strands (b) composed of a blend of at least two resins having melting points different from each other by at least about 20° C., of which a resin having the lowest melting point has a melting point at least about 20° C. lower than that of (a) continuous filaments of synthetic resin constituting the web (A) and is present in an amount of about 5 to about 95% by weight based on the weight of the resin blend, and that this sheet structure meets the requirements (i) to (v) described hereinabove and has high flexibility, excellent nap resistance, good air permeability, high strength, good heat sealability and light weight which properties have been unable to be provided in combination in the prior art.

It has further been found that the composite sheet structure of the invention has these improved properties in a well balanced combination, and can find application in a wide range of industrial, agricultural, and household fields, as packaging materials, apparels, interior finishing or decorating materials, etc.

It is an object of this invention therefore to provide a composite sheet structure having superior properties in combination which is obtained by a heat-bonding method.

Many other objects and advantages of this invention will become apparent from the following description.

The composite sheet structure of this invention is composed of (A) at least one layer of a nonwoven web composited of (a) continuous filaments of a synthetic resin, and (B) at least one layer of net-like web having intersections and being composed of (b) continuous net strands of a thermoplastic synthetic resin consisting of a mixture of at least two resins having different melting points, said web (A) and said web (B) being bonded to each other by heating.

The webs (A) and (B) may be each of a multilayer structure composed of two or more adjacent web layers.

The individual filaments (a) constituting the nonwoven web (A) are not bonded, or partly bonded, to each other. Even when they are bonded, the web (A) is preferably a web of a loose structure as a whole with the filaments being partly bonded by such means as treatment with a binder, physical intertwining, or bonding utilizing the adhesive strength of the filaments (a) themselves. In other words, the web (A) is preferably a nonwoven web which can be easily deformed by an external stress with the individual filaments (A) constituting the web being not bonded to each other, or only partly bonded loosely.

The web (A) preferably has a looseness, defined hereinbelow, of about 0.05 to about $$5.0\left(\frac{g/5\ cm}{g/m^2}\right).$$

The looseness is a measure of the loose structure of the web (A) and is measured in the following manner.

A sample, 5 cm×20 cm, is prepared, and measured at a tensile speed of 30 cm/min. with a chuck distance being kept at 10 cm by the testing method for tensile strength described in JIS L-1085.

The stress (g/5 cm) at 30% stretch based on the original length of the sample is measured, and divided by the weight of the web (A) sample per unit area (g/m$^2$). The quotient $$\left(\frac{g/5\ cm}{g/m^2}\right)$$

is defined as the looseness of the web (A).

In performing the above test, 20 samples are taken at random from web (A) having a square shape each side having a length of 1 m both in the longitudinal and transverse direction. The results obtained are averaged.

Crimped filaments are suitable as the filaments (A) for providing a nonwoven web (A) of such a loose structure. Preferably, such crimped filaments have a number of crimps of about 10 to about 40 per inch of the filaments. The filaments (A) preferably have a size of, for example, about 0.1 to about 15 denier.

The nonwoven web (A) should meet the requirement (i), i.e. should have a basis weight of about 2 to about 30 g/m$^2$, preferably about 3 to about 20 g/m$^2$, as a parameter taken in combination with the other requirements. If the basis weight of the web (A) exceeds the upper limit, its bondability with the continuous net strands constituting the web (B) and meeting the requirement (ii) is reduced, and delamination tends to occur. If the basis weight of the web (A) is below the specified lower limit, the strength of the resulting composite sheet structure is difficult to retain satisfactorily.

Preferably, the filaments (a) are distributed uniformly in the web (A). The web (A) may contain other filaments, for example regenerated filaments such as rayon filaments, semi-synthetic filaments such as acetate filaments, inorganic filaments such as carbon filaments, and natural filaments such as silk. The amount of the other filaments is preferably about 1 to about 30% by weight based on the web (A).

There is no restriction on the method of producing the nonwoven web (A) composed of the continuous filaments of synthetic resin, and any method of production can be employed which can afford a web having the aforesaid loose structure. Some examples of the method of production are described below.

One example is described in Japanese Pat. No. 27599/67. This patent discloses a method for producing a fibrous molded article composed of continuous filaments, which comprises extruding a polymeric substance, as a melt or solution, through a number of adjoining orifices to form continuous filaments, withdrawing the continuous filaments from a spinneret and stretching and solidifying them by using an undisturbed gas or vapor stream blown against the filaments substantially parallel to both side surfaces of the filament band, simultaneously transferring the entire filament band through an air conduit in the form of a open-ended flat box having a slightly larger width than the filament band as a wide as-withdrawn from the spinneret without the filaments being gathered together as a yarn, and accumulating the filament band on a collecting mold moving at a lower speed than the spinning speed after it has left the conduit, whereby the filaments are entangled into a layer.

Another example is a process for producing filamentary structure which comprises running a multifilament yarn of continuous organic synthetic filaments, electrostatically charging the yarn to separate the filaments at the charged portion, and then gathering the filaments as-separated, as shown in Japanese Pat. No. 4993/62.

Still another examples is shown in Japanese Pat. No. 6795/76 which discloses a method for producing a nonwoven fabric which comprises separating a crimped tow so that the individual filaments are aligned substantially in one direction, provisionally bonding the filaments to each other by a small amount of an adhesive to form a fibrous sheet, extending said fibrous sheet or a plurality of such fibrous sheets in a stacked condition in the widthwise direction, and treating the extended sheet structure with an adhesive or heat-melting the filaments to fix a network structure.

Among these methods, preferred is the method shown in Japanese Pat. No. 6595/76 which comprises separating a crimped tow, pre-bonding the individual filaments, and extending the fibrous sheet in the widthwise direction.

A preferred method for separating a crimped tow is the method for producing a sheet-like material which comprises feeding continuous multifilaments between a pair of rotating intermeshing gear-like rollers at a speed slower than the surface speed of the rollers to bend the multifilaments, relaxing the filaments to deposit them in sheet form, and then fixing the relative positions of the single filaments, which is disclosed in Japanese Pat. No. 6114/71.

The net-like web (B) having intersecting points and being composed of (b) continuous net strands of a blend of at least two thermoplastic synthetic resins having different melting points, which together with the web (A), constitutes the composite sheet structure of this invention, must meet the following requirement (ii) as a parameter taken in conjunction with the other requirements.

(ii) The web (B) has a basis weight of about 1 to about 10 g/m$^2$, an average net strand diameter of about 1 to about 100 microns and an average mesh length of up to about 5 mm, and said net strands (b) are composed of at least two resins having a melting points differing from each other by at least about 20° C., of which a resin having the lowest melting point has a melting point at least about 20° C. lower than that of said filaments (a) and is present in an amount of about 5 to about 95% by weight based on the weight of said resin mixture.

The requirement (ii) is an important factor for the composite sheet structure of this invention to meet the structural requirement (v) in conjunction with the requirements (i), (iii) and (iv).

As specified in the requirement (ii), the net strands (b) constituting the net-like web (B) are composed of a blend of at least two resins having different melting points from each other by at least about 20° C., for example by about 20° to about 200° C. Among these resins, the one having the lowest melting point has a melting point at least about 20° C., for example about 20° to about 200° C., lower than the melting point of the resin constituting the filaments (a). The amount of the resin having the lowest melting point is about 5 to about 95% by weight, preferably about 10 to about 90% by weight, based on the weight of the resin blend.

When a single resin is used instead of the mixture of resins having different melting points, satisfactory heat-treating conditions for the bonding of the webs (A) and (B) by heating cannot be controlled during actual operations. Consequently, even slight fluctuations in the heat-treating conditions and slight variations in other operating conditions which cannot be avoided in usual operations may result in insufficient bonding between the web (A) and the web (B), thus causing naps. Or delamination between the webs (A) and (B) may occur. Or satisfactory results can be obtained in these respects, but the entire composite sheet structure becomes close to a film-like structure and loses flexibility.

If the aforesaid requirement for the melting points of the resins making up the web (B) and the requirement for the amount of the resin having the lowest melting point among the aforesaid resins are met as described above in conjunction with the other requirements, a composite sheet structure having the requirement (v) [i.e., the filaments (a) constituting the web (A) are embraced by the net strands (b) partly at many points throughout the composite sheet structure obtained after heat-treatment] can be surely formed without likelihood of a substantial loss of the loose structure by which the web (A) of the composite sheet structure can be easily deformed by an external stress. If the difference between the melting points of the two resins constituting the resin mixture is less than about 20° C., and/or the amount of the ressin having the lowest melting point is outside the above-specified range, it is impossible in practice to form a sheet structure having the requirement (v), and the composite sheet structure of this invention having the aforesaid properties in a compatible manner cannot be obtained.

The web (B) used in this invention should have a basis weight of about 1 to about 10 g/m$^2$, preferably about 2 to about 8 g/m$^2$, an average net strand diameter of about 1 to about 100 microns, preferably about 2 to about 80 microns, and an average mesh length of up to about 5 mm, preferably about 0.1 to about 4 mm.

If the basis weight of the web (B) exceeds the above-specified upper limit, the flexibility of the composite sheet structure is reduced. If it is less than the specified limit, it is difficult to avoid the formation of fuzzes. If the average net strand diameter is larger than the above-specified limit, the flexibility of the sheet structure is reduced. If it is smaller than the specified limit, its air permeability is reduced. On the other hand, use of a net-like web having an average mesh length of more than about 5 mm leads to a sheet structure having poor nap resistance and poor heat sealability.

A preferred web (B) having the basis weight, average net strand diameter and average mesh length specified in by the requirement (ii) above such that when a straight line connecting two arbitrary points spaced from each other by a distance of 2 mm at an arbitrary part of the surface of the web (B), about 3 to about 100, particularly about 6 to about 30, net strands (b) cross this straight line.

There is no particular restriction on the method of producing the net-like web (B) which meets the requirement (ii), and any method can be used which can afford a net-like web meeting the requirement (ii). For example, there can be used (i) a method which comprises forming numerous irregular crackings in a thin film, and then extending the film, and (ii) a method which comprises rotating a two-layer ring die having numerous fine nozzles arranged annularly, and extruding a fibrous substance through these nozzles to form a net-like sheet continuously. An especially preferred method is shown in Japanese Pat. No. 3458/74, and is a method for producing an opened web which comprises extruding a molten thermoplastic resin containing a blowing agent from a die, pulling the extrudate to form a sheet-like structure having numerous non-continuous cracks in one direction, laminating a plurality of such sheet-like structures so that the directions of the cracks coincide, feeding the resulting laminate through stuffing rollers and inlet rollers in the relaxed state so that the ratio of the feed rate of the stuffing rollers to the feed rate of the inlet rollers is 1.1–3.0:1, and spreading the individual fibers of the laminate at a spreading angle of 10 to 60 degrees and a spreading ratio of 3 to 15.

The web (B) of this invention has intersecting points and is composed of continuous net strands. In particular, a net-like web of the type produced by the method disclosed in Japanese Laid-Open Patent Publication No. 3458/74 is an assembly of continuous multifilaments in which the individual net strands are connected to each other at random and spaced from each other at irregular intervals to form a number of mesh openings which differ from each other randomly and irregularly in shape and size. The aforesaid points of connection form intersecting points as branching points of the net strands.

The amount of the web (A) in the composite sheet structure of this invention is about 30 to about 90% by weight, preferably about 40 to about 80% by weight, based on the total weight of the webs (A) and (B). This requirement (iii) is an essential parameter in combination with other requirements. In other words, the weight ratio of the web (A) to web (B) per unit area in the composite sheet structure of this invention is about 30–90:about 70–10, preferably about 40–80:about 60–20. If in the composite sheet structure of this invention, the proportion of the web (A) is larger than the above specified limit, the nap resistance and heat sealability of the resulting composite sheet structure are degraded. If the proportion of the web (A) is smaller than the above-specified limit, the flexibility of air permeability of the resulting composite sheet structure are degraded. Generally, when the proportion of the web (a) increases within the above range, the flexibility of air permeability of the sheet structure tends to be improved. If, on the other hand, the proportion of the web (B) increases, the nap resistance of the sheet structure tends to increase. Thus, the suitable ratio of the web (A) to the web (B) can be selected within the above range depending upon the desired balance of the aforesaid properties.

As a parameter in combination with the other requirements, the composite sheet structure of this invention should have a basis weight of about 10 to about 200 g/m$^2$, preferably about 12 to about 150 g/m$^2$, preferably about 12 to about 150 g/m$^2$ [requirement (iv)]. If the basis weight of the sheet structure of this invention is larger than the above-specified limit, the flexibility and air permeability of the sheet structure are degraded. If on the other hand, its basis weight is smaller than the specified limit, the strength of the structure is too low to be practical.

The composite sheet structure of the present invention has a unique characteristic three-dimensional structure in the thickness direction and the planar direction (longitudinal and transverse directions). Specifically, in the composite sheet structure, the filaments (a) are embraced by the net strands (b) partly at many points throughout the composite sheet structure [requirement (v)], in addition to meeting the other requirements (i), (ii), (iii) and (iv).

This embracing structure is a structure in which the webs (A) and (B) are integrated to such an extent as to permit the loose structure of the entire web (A) in which the filaments (a) not bonded or loosely bonded of the nonwoven web (A) capable of easily deforming by an external stress can be displaced to each other relatively easily. This structure includes, for example, a structure in which the resin having the lowest melting point in the resin mixture constituting the net strands (b) of the web is melt-bonded with the filament or filaments (a) of the web (A) partly at many points, or completely or incompletely occludes the filament or filaments (a) partly at many points; or a structure in which the resin having the lowest melting point in the filaments (b) completely or incompletely bridges a plurality of layers of the web (B) having the web (A) interposed therebetween in the thickness direction of the composite sheet structure either perpendicularly or obliquely with or without the occluding structure mentioned above.

By such an embracing structure, the non-woven filaments (a) in the web (A) are partly embraced by the net strands (b) of the web (B) throughout the composite sheet structure without a loss of displaceability of these filaments to each other. Furthermore, since the web (B) is a net-like web having intersecting points and is composed of continuous net strands, the composite sheet structure of this invention meeting the aforesaid requirements (i) to (v) becomes a unique composite sheet structure having improved properties which cannot stand together in conventional composite sheet structures.

One embodiment of the composite sheet structure of this invention is described below with reference to the accompanying drawings.

The accompanying drawings are optical microphotographs of one embodiment of the composite sheet structure of this invention composed of 5 layers of the web (B) and 4 layers of the web (A) which are obtained by stacking them in the order of web (B)-web (A)-web (B)-web (A)-web (B)-web (A)-web (B)-web (A)-web (B) and bonding them by heat-treatment (300× in the case of a cross section, and 100× in the case of a surface).

Figures 1, 2:
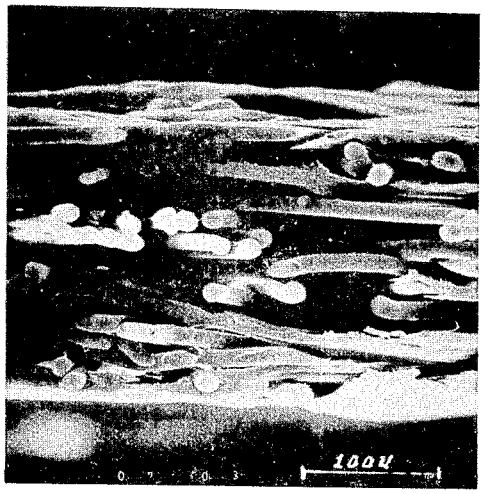
Figure 2:
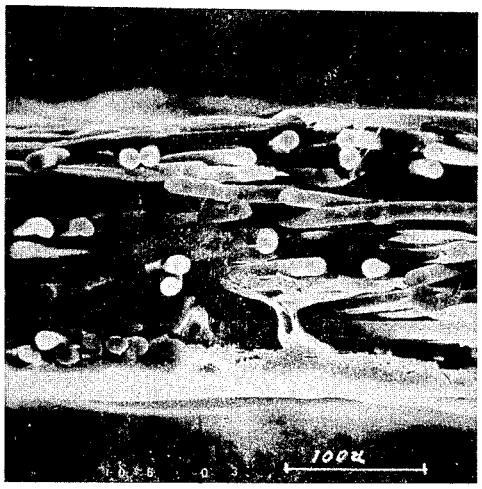

FIG. 1 is a top pan plan view of the above structure before the heat-treatment; and FIGS. 2-1 and 2-2 are partial sectional views of the aforesaid embracing structure of the composite sheet structure of this invention after the heat-treatment.

FIG. 1 well shows the net-like web overlaid on the web (A). This Figure shows the structure obtained in Example 1 given hereinbelow. As is shown in FIGS. 2-1 and 2-2, the filaments (a) of the webs (A) are bridged at many points of the composite sheet structure by the net strands (b) of the webs (B) aligned alternately with the webs (A), and are thus partly embraced throughout the composite sheet structure. The three-dimensional structure of the composite sheet structure of this invention attributed to the embracing structure of requirement (v) serves to integrate the web (A) and the web (B) without causing a loss of the loose structure of the web (A) and to impart a well-balanced combination of improved properties such as high flexibility, excellent nap resistance, good air permeability and high strength to the composite sheet structure thus obtained.

The resins for production of the webs (A) and (B) forming constituting the composite sheet structure of this invention can be selected from various combinations of resins which meet the requirement (ii). Examples of usable resins include (1) homopolymers or copolymers of ethylene, propylene, styrene, acrylic esters, vinyl acetate, acrylonitrile, vinyl chloride, etc.; (2) polyesters prepared from at least one dicarboxylic acid component (or a lower alkyl ester thereof) selected from the group consisting of aromatic dicarboxylic acids having 8 to 15 carbon atoms such as phthalic acids (e.g., phthalic acid, isophthalic acid, terephthalic acid, the nuclearly alkylated derivatives thereof) or naphthalenedicarboxylic acids, aliphatic dicarboxylic acids having 6 to 30 carbon atoms and alicyclic dicarboxylic acids having 6 to 30 carbon atoms and at least one glycol component selected from the group consisting of aliphatic glycols having 2 to 12 carbon atoms, alicyclic glycols having 2 to 12 carbon atoms and aromatic dihydroxy compounds having 6 to 15 carbon atoms, polyesters prepared from hydroxycarboxylic acids having 4 to 12 carbon atoms (or the lower alkyl esters thereof), or copolyesters thereof; (3) polyamides prepared from aliphatic dicarboxylic acids having 4 to 12 carbon atoms and aliphatic or aromatic diamines having 4 to 15 carbon atoms, polyamides prepared from amino acids (or lactams), or copolyamides thereof; (4) bisphenol-type polycarbonates; (5) polyacetals; and (6) polyurethanes.

The filaments (a) constituting the web (A) are base filaments which maintain the strength of the entire composite sheet structure, and preferably composed of a resin having a relatively high melting point. Preferably, the filaments (a) are selected from those of a resin selected from polyethylene terephthalate, polybutylene terephthalate, polycapramide, poly-m-phenylene isophthalamide, polypropylene and polyacrylonitrile, and mixtures or copolymers thereof. They are preferably stretched and oriented.

The strands (b) constituting the web (B) are preferably prepared from resins meeting the melting point requirement in (ii). Examples of preferred resins are polyesters such as polyethylene terephthalate and polybutylene terephthalate; polyamides such as polycapramide and polyhexamethylene adipamide; polyolefins such as polyethylene and polypropylene; vinyl polymers such as polyvinyl alcohol, polyvinyl acetate and polyacrylonitrile; polyurethanes; and copolymers of these. More preferably, these resins have a melting point of from 100° to 300° C.

The composite sheet structure of this invention can be produced by stacking at least one layer of the web (A) meeting the aforesaid requirement (i) and at least one layer of the web (B) meeting the aforesaid requirement (ii) alternately so that the aforesaid embracing structure can be formed, and then heat-treating the stacked assembly. Preferably, a least one outermost layer of the assembly is a layer of the net-like web (B).

The heat treatment whereby the webs (A) and (B) are bonded to each other in the embracing structure can be performed, for example, by passing the stacked sheet-like assembly between one pair, or a plurality of pairs, of hot press rollers. Preferably, these press rollers have a flat surface.

The above heat-treatment is carried out preferably at a temperature X (°C.) defined by the following equations [I] and [II], and more preferably by equation [I]'.

$$\Sigma[(T_1-T_n)\times(W_1-W_n/100)]+30\geqq X\geqq\Sigma[(T_1-T_n)\times(W_1-W_n/100)]-30 \quad [I]$$

$$T_{(a)}-30\geqq X \quad [II]$$

$$\Sigma[(T_1-T_n)\times(W_1-W_n)/100]+25\geqq X\geqq\Sigma[(T_1-T_n)+(W_1-W_n)/100]-25 \quad [I]'$$

In the above equations, $T_1$, $T_2$, $T_3$, . . . $T_n$ are the melting points (decomposition points when no melting point is shown) of the resins having melting points differing from each other by at least 20° C. in the resin mixture constituting the net strands (b); $W_1$, $W_2$, $W_3$, . . . $W_n$ represent the proportions in weight percentage of these resins in the resin mixture; and $T_{(a)}$ is the melting point (decomposition point when no melting point is shown) of the resin which constitutes the filaments (a).

In any case, it is recommended that the heat-treatment be carried out at a temperature which is at least 30° C. lower than the melting point of the filaments (a) but not more than a temperature which is 30° C. lower than the melting point of a resin having the lowest melting point among the resins in the resin mixture constituting the web (B).

Since the composite sheet structure of this invention is composed of a high-melting component and a low-melting component and can be easily formed into a bag having a firm sealed portion by a well-known method such as heat sealing or high-frequency sealing, it is useful as a packaging material having flexibility, high strength, good air permeability and reduced nap. By selecting a polymer component having good weatherability, the sheet structure of this invention is also useful as an agricultural material having reduced nap, high flexibility and good air permeability. By taking advantage of the many characteristics mentioned hereinabove, the composite sheet structure of this invention finds wide applications as general industrial materials, household goods, sanitary materials and apparel materials.

The composite sheet structure of this invention may further contain suitable additives for the purpose of improving or imparting coloration, electrical properties, chemical properties, physical properties, and other properties. Examples of the additives are pigments, antistatic agents, fire retardants, plasticizers, antioxidants, stabilizers, ultraviolet absorbers, lubricants, oiling agents, and perfumes.

By laminating two or more layers of the composite sheet structure, a laminate can be obtained. Lamination in this case is carried out, for example, by a bonding means using a binder, a physical bonding means such as needle punching, a sewing means using a sewing machine, or hot pressing. In making the laminate, the composite sheet structures may be bonded at their entire surfaces, or only partly.

The composite sheet structure of the invention may also be laminated to another sheet material such as a woven or knitted cloth, a nonwoven cloth, paper, a glass mat, a film, a foamed sheet, a corrugated paperboard, or a metallic meshwork.

In the present invention, the average net strand diameter in the web (B), the average mesh length of the web (B), the fiber density of the web (B), and the various properties of the composite sheet structure are determined by the following methods.

(1) Average mesh length of the web (B)

An arbitrarily selected section having an area of 10 $cm^2$ of the surface of the web (B) was microphotographed. The distance l' between two adjoining intersections of the network structure is measured by a caliper at 100 points. The quotient obtained by dividing the total distances measured by the number of measurements is defined as the average mesh length (l, mm) shown by equation (III) below.

$$l=\frac{\sum_{n=1}^{100} l_i}{n} \quad (III)$$

(2) Average diameter of the net strands (b) of web (B)

A straight line is drawn on the microphotograph obtained in (1) above at an arbitrary angle to the net strand (b) and the diameter ($d_i$) of the net strand at the intersecting point is measured (at 100 points). The quotient (d in microns) obtained by dividing $d_i$ by the number (n) of measurings is defined as the average diameter of the net strand.

$$d=\frac{\sum_{n=1}^{100} di}{n} \quad (IV)$$

(3) Fiber density of the web (B)

On the microphotograph obtained in (1) above, the number (n) of net strands (b) crossing a straight line connecting arbitrarily selected two points apart from each other by a distance of 2 mm is counted. On the other hand, two points apart from each other by a distance of 2 mm are selected arbitrarily on a straight line drawn at right angles to the aforesaid straight line, and the number (n') of net strands (b) crossing the straight line between these two points is counted. The fiber density (Fd) is determined by equation (V) below.

$$Fd=(n+n')/2 \quad (V)$$

(4) Strength of the composite sheet structure

A sample, 5 cm×20 cm, is prepared, and its tensile strength is measured by the method described in JIS L-1985 at a pulling speed of 30 cm/min. with a chuck distance of 10 cm.

The strength of the composite sheet structure is expressed by the quotient obtained by dividing the tensile strength (g/5 cm) by the weight of the sheet structure per unit area (g/m$^2$).

Preferably, the composite sheet structure of this invention has a strength of about 100 to about 400

$$\left(\frac{\text{g/5 cm}}{\text{g/m}^2}\right)$$

In performing this test, 20 samples are taken randomly both in the longitudinal and transverse directions from a sheet structure sample of a square shape with one side measuring 1 m, and the result is an average of the measured values obtained on these samples.

(5) Flexibility of the composite sheet structure (5-1) Initial Young's modulus

This is one measure of the degree of flexibility. Low Young's moduli mean that under an external force, the composite sheet structure is easily deformed.

The tensile test described in JIS L-1085 is conducted, and from the resulting load-elongation curve, the initial Young's modulus is calculated in accordance with the equation described in Paragraphs 5 to 10, Remark 2 of JIS L-1074. As the specific gravity used in this equation, the apparent bulk density (g/cm$^3$) is used.

Preferably, the composite sheet structure of this invention has an initial Young's modulus of about 0.5 to about 40 kg/mm$^2$ (an average of the measured values obtained in the longitudinal and transverse directions).

(5-2) Stiffness

This is another measure of the degree of flexibility, and is measured by the method A (45° cantil cantilever method) in Paragraphs 5 to 7 of JIS L-1085. The quotient obtained by dividing the resulting measured value (mm) by the weight of the sheet structure per unit area (g/m$^2$) is defined as stiffness $$\left(\frac{\text{mm}}{\text{g/m}^2}\right)$$

in this application.

The composite sheet structure of this invention preferably has a stiffness of about 0.5 to about 8

$$\frac{\text{mm}}{\text{g/m}^2}.$$

In performing this test, 10 samples are taken randomly both in the longitudinal and transverse directions from a sheet structure sample of a square shape with one side measuring 1 m, and the result is an average of the measured values obtained on these samples.

(6) Air permeability of the composite sheet structure

Air permeability can be determined by passing air at a predetermined flow rate through the composite sheet structure of a predetermined area, and measuring the difference in pressure on both sides of the structure.

The composite sheet structure is placed at right angles to a vinyl chloride resin cylinder having an inside diameter of 60 mm at a position intermediate in the cylinder. From one end of the cylinder, air is caused to flow at a rate of 3 m/sec. through a rectifying plate, and the difference in pressure between both sides of the structure is measured by a manometer. As a result, the air resistance (mm Aq.) at the time of passing air at 3 m/sec. through the structure with a cross-sectional area of 28.3 cm$^2$ can be determined. The quotient obtained by dividing the air resistance (mm Aq.) by the weight of the structure per unit area (g/m$^2$) is defined as air permeability.

$$\left(\frac{\text{mm. Aq.}}{\text{g/m}^2}\right).$$

In performing this test, 5 samples are taken randomly both in the longitudinal and transverse directions from a sheet structure sample of a square shape with one side measuring 1 m, and the result is an average of the measured values obtained on these samples.

(7) Nap resistance of the composite sheet structure

The surface of the composite sheet structure is rubbed under certain conditions, and the state of napping is observed.

This is performed by using a rubbing tester (Model I) described in paragraph 3 of JIS L-9823. The surface of the rubbing member is made of a white cotton cloth, and the load applied is 1.5 kg. The end point of the test is the time when crumpled fuzzy fibers occur in the course of the fibers being removed from the surface of the sheet structure sample, and the number of rubbings done until the end point is reached is measured.

In performing this test, 20 samples are taken randomly both in the longitudinal and transverse directions from a sheet structure sample of a square shape with one side measuring 1 m, and the result is an average of the measured values obtained on these samples.

Preferably, the sheet structure of this invention has a nap resistance of about 25 to about 200 times.

The following Examples and Comparative Examples illustrate the present invention without any intention of limiting the invention thereby.

EXAMPLE 1

Polyethylene terephthalate filaments having a monofilament denier size of 6 denier were aligned substantially parallel to each other so that the total denier size of these filaments was 1,300,000 denier. They were stretched to 4 times, crimped at a rate of 18/inch, and heat-set at 180° C. for 2 minutes. The resulting product was again stretched to form a sheet. The sheet was fed between a pair of intermeshingly rotating gear-like rollers at a speed slower than the surface speed of the rollers to spread it continuously, and extended to a width of 1.5 m by an arcuate bar. The product was entirely impregnated with an emulsion-type adhesive obtained by adding a small amount of an emulsifier to an ethyl acrylate/butylacrylate (50:50 by weight) so that the pick-up was 4% by weight. The impregnated product was dried at 100° C. to form a sheet having a basis weight of 30 g/m$^2$ and composed of parallel filaments.

The sheet obtained was extended to 13.5 times in the widthwise direction by a pin tenter while feeding it at an overfeed of 1.8 times to obtain a nonwoven random web (A) having a monofilament denier size of 1.5 denier and a basis weight of 4 g/m$^2$.

Separately, a mixture consisting of 85% by weight of polypropylene, 10% by weight of nylon-6 and 5% by weight of polyethylene was melted by an extruder, and nitrogen gas was introduced into the melt. The polymer melt was extruded from a slit die, and taken up under draft while quenching the extrudate. Thus, a burst fiber sheet having a basis weight of 1.7 g/m$^2$ and containing numerous non-continuous cracks in the longitudinal direction was obtained.

Eight layers of the fiber sheet were stacked, and extended to 14.4 times in the widthwise direction while feeding it at an overfeed of 1.8 times. Thus, a reticulate continuous fiber sheet (B) was obtained. The sheet (B) had an average monofilament diameter of 40 microns and a basis weight of 1.7 g/m$^2$, and the individual fibers were continuous and formed a network structure.

Seven layers of the web (A) and 8 layers of the s sheet (B) were laminated alternately to provide a laminated structure in which both outermost layers were composed of the sheet (B).

The temperature X (°C.) suitable for heat-treating this laminate was determined from equations [I]' and [II] as $189 \geqq X \geqq 139$ because the polyethylene terephthalate had a melting point of 260° C., polypropylene had a melting point of 160° C., nylon 6 had a melting point of 225° C., and polyethylene had a melting point of 110° C.

The laminated structure was pressed by a pair of hot press rollers having a flat surface and kept at a surface temperature of 160° C. to form a nonwoven cloth having a basis weight of 41.6 g/m$^2$ in which the weight ratio of the webs (A) to the webs (B) was 67:33.

The product was observed by an electron microscope. It was found that the surface layer of web (B) had a mesh size of 1.04 mm on an average, a fiber density of 19 on an average, and a fiber diameter of 40 microns on an average, and that some of the filaments of the web (A) were embraced by the fibers of the webs (B).

The properties of the resulting nonwoven cloth were determined by the methods described hereinabove. It was found to have excellent quality with reduced nap, high flexibility, high strength and good air permeability.

EXAMPLE 2

A nonwoven cloth was produced in the same way as in Example 1 except that 3 layers of the web (A) and 4 layers of the sheet (B) were laminated. Two layers of the resulting nonwoven cloth were laminated, and heat-sealed at 200° C. The two layers could be bonded to each other very firmly.

EXAMPLE 3

The procedure of Example 1 was repeated except that the sheet (B) was produced from a mixture of 70% by weight of polyethylene terephthalate and 30% by weight of polypropylene and 0.5 part of Tinuvin 327 (a trademark for an ultraviolet absorber made by Ciba-Geigy), both the web (A) and the sheet (B) were extended to 10 times at an overfeed of 1.5 times, and the composite structure composed of the webs (A) and the sheets (B) was hot-pressed at a temperature of 200° C.

The resulting nonwoven cloth had reduced nap, high strength and good air permeability, and could retain these properties for a long period of time in outdoor use as an agricultural protective sheet.

EXAMPLE 4

Polyacrylonitrile filaments having a monofilament denier of 1.7 denier were aligned substantially parallel to each other so that the total denier size of the filaments was 150,000 denier, crimped at a rate of 20/inch, and continuously spread to stretch it in the widthwise direction. The resulting sheet was impregnated to a pickup of 8% with a solution (concentration 20%) of polyurethane/acrylonitrile-butadiene copolymer (weight ratio of 80/20) in a mixture of butyl acetate and dimethylformamide (4:1 by weight), and then dried. The sheet was then stretched to 9 times at an overfeed of 2 times to afford a web (A) having a basis weight of 4.9 g/m$^2$.

Seven layers of the resulting web (A) and 8 layers of the sheet (B) obtained in Example 1 were stacked alternately to obtain a laminated assembly in which both outermost layers were composed of the sheet (B). The assembly was pressed by a pair of hot press rollers having a flat surface and kept at a surface temperature of 160° C. to afford a nonwoven cloth having a basis weight of 48 g/m$^2$, good flexibility and reduced nap.

A decorative design was printed on the resulting nonwoven cloth, and a bed cover having high strength, good flexibility and reduced napping was made from it.

EXAMPLE 5

Oriented nylon-6 filaments having a monofilament denier size of 1.2 denier were aligned substantially parallel to each other so that the total denier size of the filaments was 200,000 denier. These filaments were crimped at a rate of 18/inch, and treated in the same way as in Example 1 to afford a nonwoven web (A) having a basis weight of 11 g/m$^2$.

A mixture of 80% by weight of polypropylene, 10% by weight of nylon-6 and 10% by weight of polyethylene was treated in the same way as in Example 1 to afford a reticulated continuous fiber sheet (B) having a basis weight of 2.5 g/m$^2$.

Nine layers of the web (A) and 10 layers of the sheet (B) were stacked alternately so that the sheet (B) formed both outermost layers. The assembly was pressed at 165° C. to obtain a nonwoven fabric having a basis weight of 124 g/m$^2$.

The resulting nonwoven fabric was observed by a microscope. It was found that the sheet (B) had a mesh size of 0.93 mm on an average, a fiber density of 22 on an average, and a fiber diameter of 33 microns on an average, and that some of the filaments in the web (A) were embraced by the fibers of the sheets (B).

The resulting nonwoven fabric had the properties within the ranges of this invention.

COMPARATIVE EXAMPLE 1

Eight layers of the web (A) obtained in Example 1 were stacked, and pressed by a pair of hot press rollers having a flat surface and kept at a surface temperature of 200° C. An emulsion-type adhesive obtained by emulsifying a copolymer of butyl acrylate and methacrylate (50/50) with a small amount of an emulsifier, and impregnated in the resulting laminate to a pick-up of 20% by weight. The impregnated laminate was dried to afford an adhesive-bonded nonwoven fabric having a basis weight of 38.4 g/m$^2$. The fabric was liable to develop fuzzes.

COMPARATIVE EXAMPLE 2

Six layers of the web (A) obtained in Example 1 were stacked, and a web having a basis weight of 10 g/m$^2$ obtained by card forming of polypropylene staples having a cut length of 2 cm and a single fiber denier size of 2 denier was laminated to both surfaces of the laminated structure. The laminated assembly was bonded into a unitary surface by needle punching, and then hot-pressed under the same conditions as in Example 1.

The properties of the resulting non-woven fabric were measured by the methods described hereinabove. Great variations were noted in the flexibility, air permeability and nap resistance of the resulting nonwoven fabric.

COMPARATIVE EXAMPLE 3

Eight layers of the web (A) and seven layers of the web (B) were alternately stacked, so that the web (A) formed both outermost layers, and the stacked assembly was hot-pressed at 200° C. Otherwise, the same procedure as in Example 1 was repeated. On rubbing, the resulting structure immediately developed fuzzes because it did not contain the sheet (B) as a surface layers.

COMPARATIVE EXAMPLE 4

Example 1 was repeated except that the cooling conditions after extrusion in the production of the sheet (B) were changed to provide a sheet (B) having a thick fiber diameter and a coarse mesh size.

The resulting structure was examined by an electron microscope. The mesh size of the surface layer of the sheet (B) was 11 mm on an average, and the fiber diameter was 160 microns on an average.

The resulting structure had harder tactile hand and was more liable to develop nap than the sheet structure obtained in Example 1.

COMPARATIVE EXAMPLE 5

A sheet (B) having a basis weight of 2.1 g/m$^2$ was produced from nylon-6 alone by the same method as in Example 1. Layers of the sheet (B) were laminated in combination with the layers of the web (A) obtained in Example 1 and pressed at a temperature of 200° C. The resulting structure was liable to develop naps.

COMPARATIVE EXAMPLE 6

Stretched split yarns made from polyethylene were laminated so that those yarns aligned longitudinally crossed at right angles to those aligned transversely. They were hot-pressed at 100° C. to form a split yarn sheet (A) having a basis weight of 25.6 g/m$^2$.

Separately, a sheet (B) was produced in the same way as in Example 1 except that the sheet (B) was produced from a mixture of 50% by weight of polyethylene and 50% by weight of polypropylene.

Layers of the sheets (A) and (B) were laminated so that they were arranged in this way (B)+(B)+(A)+(B)+(B)+(A)+(B)+(B). The laminated assembly was hot-pressed at 120° C. to form a nonwoven fabric having a basis weight of 61.4 g/m$^2$. The resin having the lowest melting point in the sheet (B) (i.e., polyethylene) had the same melting point as the split yarn sheet (A), and the hot pressing was performed at this melting point. Hence, the resulting nonwoven fabric was very much like a film, and lacked flexibility.

Table 1 summarizes the properties of the products obtained in the above Examples and Comparative Examples.

TABLE 1

(1-1)

| Properties | Example 1 | 2 | 3 | 4 | 5 |
|---|---|---|---|---|---|
| Resin of web (A) | PET | PET | PET | PAN | Ny-6 |
| Basis weight of web (A) (g/m$^2$) | 4 | 4 | 4.5 | 4.9 | 11 |
| Monofilament denier of web (A) (denier) | 1.5 | 1.5 | 1.5 | 1.7 | 1.2 |
| Resin composition of web (B) (%) | PP/Ny-6/PE =85/10/5 | PP/Ny-6/PE =85/10/5 | PET/PP =70/30 | PP/Ny-6/PE =85/10/5 | PP/Ny-6/PE =80/10/10 |
| Basis weight of web (B) (g/m$^2$) | 1.7 | 1.7 | 2.0 | 1.7 | 2.5 |
| Average fiber diameter of web (B) (microns) | 40 | 40 | 51 | 40 | 33 |
| Average mesh size of web (B) (mm) | 1.04 | 1.04 | 1.87 | 1.04 | 0.93 |
| Fiber density of web (B) (number) | 19 | 19 | 12 | 19 | 22 |
| Surface of the composite structure of webs (A) and (B) | web (B) | web (B) | web (B) | web (B) | web (B) |
| Basis weight of the composite structure (g/m$^2$) | 41.6 | 36.2 | 47.5 | 47.9 | 124 |
| Weight ratio of web (A)/web (B) in the composite structure | 67/33 | 64/36 | 67/33 | 72/28 | 80/20 |
| Heat-treating temperature (°C.) | 160 | 160 | 200 | 160 | 165 |
| Strength $\left(\frac{g/5cm}{g/m^2}\right)$ | 290 | 267 | 218 | 202 | 184 |
| Flexibility | | | | | |
| Initial Young's modulus (kg/mm$^2$) | 8 | 5 | 38 | 6 | 10 |
| Stiffness $\left(\frac{mm}{g/m^2}\right)$ | 3.1 | 2.2 | 4.1 | 2.0 | 2.4 |

TABLE 1-continued

| | | | | | |
|---|---|---|---|---|---|
| Air permeability $\left(\frac{\text{mm Aq.}}{\text{g/m}^2}\right)$ | 1.9 | 0.9 | 3.9 | 1.5 | 3.1 |
| Nap resistance (number of rubbing cycles) | 52 | 49 | 104 | 38 | 87 |

(2-1)

| Properties | Comparative Example 1 | 2 | 3 | 4 | 5 | 6 | Ranges specified by the invention (*) |
|---|---|---|---|---|---|---|---|
| Resin of web (A) | PET | PET | PET | PET | PET | PE | |
| Basis weight of web (A) ($g/m^2$) | 4 | 4 | 4 | 4 | 4 | 25.6 | 2-30 |
| Monofilament denier of web (A) (denier) | 1.5 | 1.5 | 1.5 | 1.5 | 1.5 | 360 | (0.1-15) |
| Resin composition of web (B) (%) | None | PP = 100 (staples) | PET/Ny-6/PE = 85/10/5 | PET/Ny-6/PE = 85/10/5 | Ny-6 = 100 | PE/PP = 50/50 | |
| Basis weight of web (B) ($g/m^2$) | — | 10 | 1.7 | 1.7 | 2.1 | 1.7 | 1-10 |
| Average fiber diameter of web (B) (microns) | — | 2 de. | 40 | 160 | 37 | 44 | 1-100 |
| Average mesh size of web (B) (mm) | — | — | 1.04 | 11 | 0.93 | 1.11 | ≦5 |
| Fiber density of web (B) (number) | — | — | 19 | 1 | 21 | 18 | (3-100) |
| Surface of the composite structure of webs (A) and (B) | — | web (B) | web (A) | web (B) | web (B) | web (B) | |
| Basis weight of the composite structure ($g/m^2$) | 38.4 | 44 | 43.9 | 41.6 | 44.8 | 41.6 | 10-200 |
| Weight ratio of web (A)/web (B) in the composite structure | — | 55/45 | 73/27 | 67/33 | 63/37 | 83/17 | 90-30/10-70 |
| Heat-treating temperature (°C.) | 200 | 160 | 200 | 160 | 200 | 120 | |
| Strength $\left(\frac{\text{g/5cm}}{\text{g/m}^2}\right)$ | 197 | 175 | 241 | — | 245 | 326 | (100-400) |
| Flexibility | | | | | | | |
| Initial Young's mogulus ($kg/mm^2$) | 42 | 41 | 7 | 35 | 7 | 83 | (0.5-40) |
| Stiffness $\left(\frac{\text{mm}}{\text{g/m}^2}\right)$ | 3.4 | 5.8 | 5.3 | 8.3 | 4.7 | 11.0 | (0.5-8) |
| Air permeability $\left(\frac{\text{mm Aq.}}{\text{g/m}^2}\right)$ | 2.8 | 4.6 | 0.3 | — | 0.5 | 0.8 | (0.1-5) |
| Nap resistance (number of rubbing cycles) | 5 | 14 | 3 | 17 | 11 | 36 | (25-200) |

(*): The parenthesized figures show preferred ranges.

What we claim is:

1. A composite sheet structure comprising (A) a non-woven web composed of (a) continuous filaments of a synthetic resin and (B) a net-like web having intersecting points and being composed of (b) continuous net strands of a mixture consisting of at least two thermoplastic synthetic resins having different melting points, said web (A) and said web (B) being bonded to each other by heating; characterized in that (i) said web (A) has a basis weight of about 2 to about 30 $g/m^2$, (ii) said web (B) has a basis weight of about 1 to 10 $g/m^2$, an average net strand diameter of about 1 to about 100 microns, and an average mesh length of up to about 5 mm, and said net strands (b) are composed of at least two resins having melting points differing from each other by at least about 20° C., of which a resin having the lowest melting point has a melting point at least about 20° C. lower than that of said filaments (a) and is present in an amount of about 5 to about 95% by weight based on the weight of said resin mixture, (iii) the amount of said web (A) is about 30 to about 90% by weight based on the total weight of said webs (A) and (B), (iv) said composite sheet structure has a basis weight of about 10 to about 200 $g/m^2$, and (v) said filaments (a) are partly embraced by said net strands (b) throughout the composite sheet structure.

2. The composite sheet structure of claim 1 wherein said filaments (A) have a denier size of about 0.1 to about 15 denier.

3. The composite sheet structure of claim 1 wherein said filaments (a) have crimps.

* * * * *